US005973322A

United States Patent [19]

Rockwood

[11] Patent Number: 5,973,322

[45] Date of Patent: Oct. 26, 1999

[54] COLLISIONAL AXIALIZATION OF IONS IN A SUPERSONIC EXPANSION FOR ION INJECTION INTO TIME OF FLIGHT MASS SPECTROMETERS

[75] Inventor: Alan L. Rockwood, Provo, Utah

[73] Assignee: Sensar Corporation, Provo, Utah

[21] Appl. No.: 09/039,292

[22] Filed: Mar. 14, 1998

[51] Int. Cl.[6] ..... H01J 49/42

[52] U.S. Cl. ..... 250/288; 250/287

[58] Field of Search ..... 250/288, 287, 250/292

[56] References Cited

U.S. PATENT DOCUMENTS

| | | | |
|---|---|---|---|
| 4,885,076 | 12/1989 | Smith et al. | 250/288 |
| 5,652,427 | 7/1997 | Whitehouse et al. | 250/288 |
| 5,767,513 | 6/1998 | Dressler et al. | 250/292 |

*Primary Examiner*—Kiet T. Nguyen
*Attorney, Agent, or Firm*—Thorpe, North & Western

[57] ABSTRACT

A method and apparatus for collimating ions being emitted from a supersonic expansion nozzle for injection into a time of flight mass spectrometer. Radio frequency fields are used to focus ions toward a desired path, while energy is dissipated from the ions by using a background gas which is advantageously part of a supersonic expansion, giving the background gas a highly organized velocity profile. The background gas absorbs energy when the ions collide with the background gas molecules. By causing the collisional cooling between the ions and the background gas molecules to occur within the supersonic expansion, the ions do not receive velocity distributions determined by ambient thermal energies, but instead enables generation of a highly collimated and high intensity ion beam directed toward the time of flight mass spectrometer.

5 Claims, 2 Drawing Sheets

COLLISIONAL AXIALIZATION OF IONS IN A SUPERSONIC EXPANSION FOR ION INJECTION INTO TIME OF FLIGHT MASS SPECTROMETERS

BACKGROUND

1. Field of the Invention

This invention relates to an improved method for injection of ions into a time of flight mass spectrometer. More specifically, apparatus which provides collisional focusing is coupled to a supersonic expansion nozzle to thereby collimate the ions in the expanding gas being emitted therefrom.

2. The State of The Art

The state of the art for injection of ions into a time of flight mass spectrometer has described the use of supersonic expansions. FIG. 1 shows where ions are entrained in a directed flow of gas in a supersonic expansion. More specifically, in a supersonic expansion, an expanding gas 12 forms a jet emanating from a supersonic expansion nozzle 10. The expanding gas 12 is flowing from a higher pressure region into a lower pressure region. Accordingly, the molecular velocities become highly organized. This is because they are directed away from the supersonic expansion nozzle 10 with nearly equal velocities, and thus fan out in a roughly cone-shaped profile 12 as if the supersonic expansion nozzle 10 formed a virtual point source for the ions.

One consequence of the dynamics of this process is that the velocity distribution of the ions (as well as that of neutral gas molecules forming the jet) is greatly narrowed compared to a typical thermal velocity distribution. This is a highly desirable condition for injection of ions 12 into an entrance 16 of a time of flight mass spectrometer 14 because it allows higher resolutions to be achieved in a properly designed instrument.

However, one disadvantage of this approach is that because the jet profile is roughly cone-shaped 12, the ion beam is not well collimated, thus negating much of the inherent advantage of the approach such as the ability to achieve high resolution.

Given that it is desirable to obtain a well collimated beam of ions, there have been various attempts to accomplish this objective. For example, FIG. 2 shows that it is possible to place an aperture 18 between the jet expansion 12 from the supersonic expansion nozzle 10 and the entrance 16 for ions to enter into the time of flight mass spectrometer 14. If the distance between the supersonic expansion nozzle 10 and the aperture 18 is large compared to the distance between the aperture 18 and the mass spectrometer entrance 16, a fairly well collimated beam can be produced. Disadvantageously, this also produces a large loss of ion intensity. Very few of the ions are directed at the entrance 16 of the mass spectrometer 14.

FIG. 3 shows that an alternative method for producing a collimated ion beam is to place an electrostatic lens 20 (or magnetic lens) between the supersonic expansion nozzle 10 and the time of flight mass spectrometer 14. A focusing condition can then be chosen so as to collimate the ion beam, thus injecting a higher proportion of the ion beam 12 into the mass spectrometer 14. Disadvantageously, the focusing condition can be chosen only to collimate ions over a limited kinetic energy range. This is undesirable because ions in the jet expansion typically have a variety of kinetic energies. This is a consequence of the fact that the ions have nearly the same velocities, but different masses. As a result, the collimation occurs only for ions of a restricted mass range, limiting the high resolution capability of the time of flight mass spectrometer to a fairly narrow range of masses.

It would be an advantage over the state of the art to provide a means whereby ions being emitted from a supersonic expansion nozzle can be collimated without having to restrict the resolution of the time of flight mass spectrometer, and without loss of ion intensity.

OBJECTS AND SUMMARY OF THE INVENTION

It is an object of the present invention to provide an improved apparatus for injecting ions into a time of flight mass spectrometer.

It is another object to provide an improved apparatus for collimating ions which are being injected by a supersonic expansion nozzle into the time of flight mass spectrometer.

It is another object to provide an improved apparatus for collimating ions which does not cause a loss of ion intensity.

It is another object to provide an improved apparatus for collimating ions which does not limit the resolution of the time of flight mass spectrometer receiving the ions.

It is another object to provide an improved apparatus for collimating ions which utilizes a collisional focusing technique.

It is another object to provide an improved apparatus for collimating ions which utilizes radio frequency fields to focus ions into a desired path.

It is another object to provide an improved apparatus for collimating ions which utilizes radio frequency fields for focusing, and a background gas to function as an energy dissipative process, where the background gas is not static, but rather in the supersonic expansion.

The present invention provides a method and apparatus for collimating ions being emitted from a supersonic expansion nozzle for injection into a time of flight mass spectrometer. Radio frequency fields are used to focus ions toward a desired path, while energy is dissipated from the ions by using a background gas which is advantageously part of a supersonic expansion, giving the background gas a highly organized velocity profile. The background gas absorbs energy when the ions collide with the background gas molecules. By causing the collisional cooling between the ions and the background gas molecules to occur within the supersonic expansion, the ions do not receive velocity distributions determined by ambient thermal energies, but instead enables generation of a highly collimated and high intensity ion beam directed toward the time of flight mass spectrometer.

In a first aspect of the invention, the ions emitted from the supersonic expansion nozzle collide with a background gas within the supersonic expansion which also possesses a highly organized velocity profile, thus enabling the ions to maintain their high intensity.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawstrings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

Figure 4:
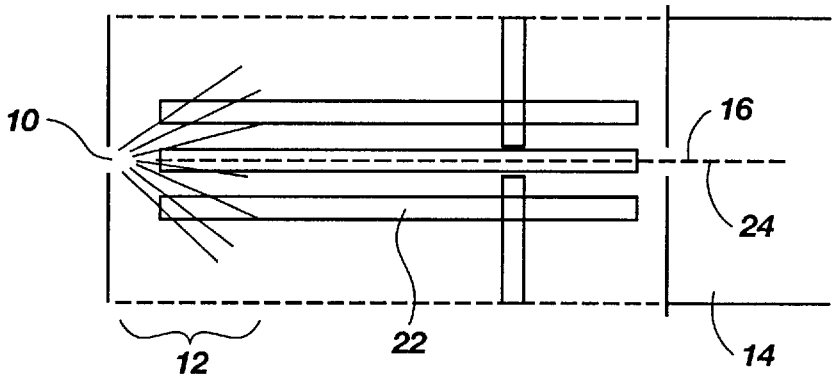
FIG. 4 is a profile cross-sectional view of the presently preferred embodiment and is made in accordance with the principles of the present invention, where the supersonic expansion being used to generate the ions is also used to generate a dynamic background gas which is also within the supersonic expansion.

The present invention proposes to use a technique known as collisional focusing or collisional cooling to produce a well collimated beam of high intensity ions in a way which has not been done before. In collisional cooling, radio frequency (RF) fields are used to focus ions toward an axis defined by the RF fields. The RF fields can be generated, for example, by an RF quadrupole. Such a configuration is shown in FIG. 4, where there is shown the supersonic expansion nozzle 10, the cone-shaped supersonic expansion of ions 12, and the entrance 16 into the time of flight mass spectrometer 14. An RF quadrupole 22 is also shown. It must be remembered that the relative sizes and distances are not shown exactly to scale, but are for illustration purposes only.

By itself this process of collisional cooling is not sufficient to axialize the ions emitted from the supersonic expansion nozzle 10 because in the absence of energy dissipative processes, the ions would simply cross and then recross the axis (dotted line 24), much as the bob of a frictionless pendulum recrosses the bottom of its arc without coming to rest. However, if a background gas is present, ions can dissipate energy through collisions with background gas molecules. This acts in a manner analogous to friction in a pendulum, allowing ions to relax toward the axis.

This approach has been used in prior art as part of an injection system for introducing ions into a time of flight mass spectrometer. However, in the prior art, the background gas consisted of a relatively static background gas. The background gas was simply present along the path between the supersonic expansion nozzle 10 and the entrance 16 to the mass spectrometer 14. Consequently, the highly organized velocity profile that exists in a supersonic beam of ions does not exist. Since the ions have velocity distributions which are now going to be determined by the ambient thermal energies of the background gas, efficient focusing of the ion beam can be difficult.

The present invention also uses collisional cooling for injecting ions 12 into a time of flight mass spectrometer 14, but in a somewhat different configuration than that previously described.

In the presently preferred embodiment, the collisional focusing occurs not in the presence of a static background gas, but rather in the presence of a supersonic expansion gas. In other words, the background gas is given a similar highly organized velocity profile as compared to the ions. Those skilled in the art are familiar with methods for causing this velocity profile to occur.

The axis 24 of the supersonic expansion is preferably chosen to approximately coincide with the axis of the RF field which may typically be a quadrupolar RF field. However, it should be realized that this RF field is not necessarily limited to quadrupolar symmetry.

Figure 5:
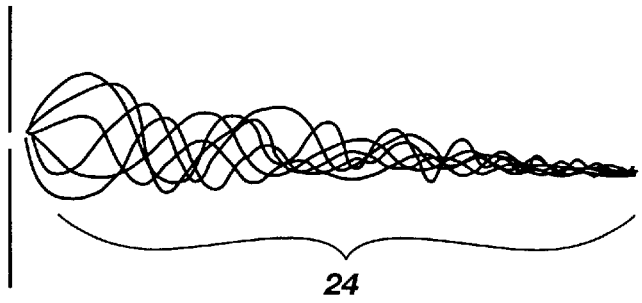
FIG. 5 is an example of the path followed by various ions emitted from the supersonic expansion nozzle.

In this configuration of the presently preferred embodiment, collisional cooling causes the ion beam to relax toward the axis. FIG. 5 is provided as an illustration of several ions as their paths "relax" towards the axis 24 of the RF field. This ultimately results in a highly collimated and high intensity ion beam concentrated near the axis 24.

Figure 1:
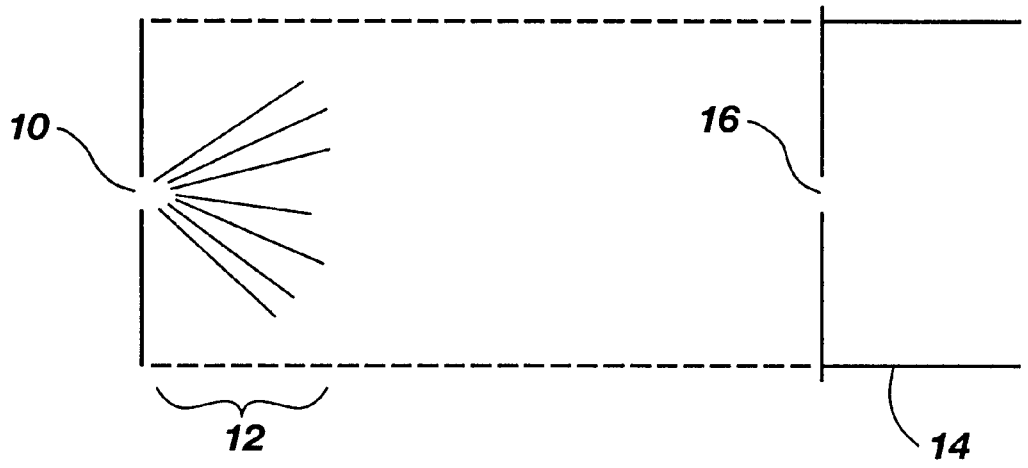
Fig. 1 (PRIOR ART)
FIG. 1 is a profile cross-sectional view of the prior art where a supersonic expansion is being used to provide ions for injection into a mass spectrometer which are highly organized and of high intensity.
Figure 2:
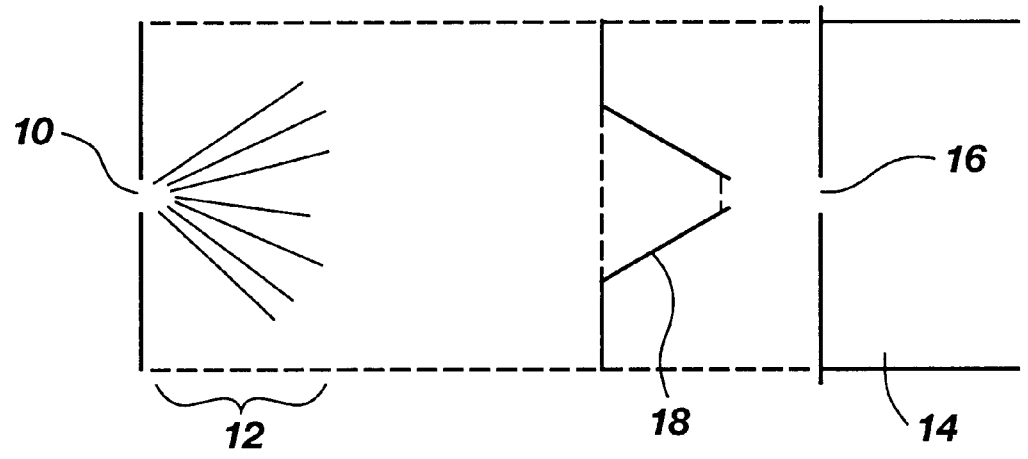
Fig. 2 (PRIOR ART)
FIG. 2 is a profile cross-sectional view of the prior art where a supersonic expansion is being used as in FIG. 1, but with the addition of a mechanical focusing aperture.

It should be noted that in this presently preferred embodiment, this collimation is achieved without requiring collimating apertures. However, in an alternative embodiment, apertures may be present in the system, for example, for purposes of differential pumping in the vacuum system, Nevertheless, apertures such as those shown in FIG. 2 could also be used in conjunction with the RF quadrupole of FIG. 4 and also function as collimating apertures as an adjunct to collisional focusing. However, collisional focusing in the supersonic ion beam is one of the most novel aspects in collimation rather than reliance strictly on collimating apertures.

Figure 3:
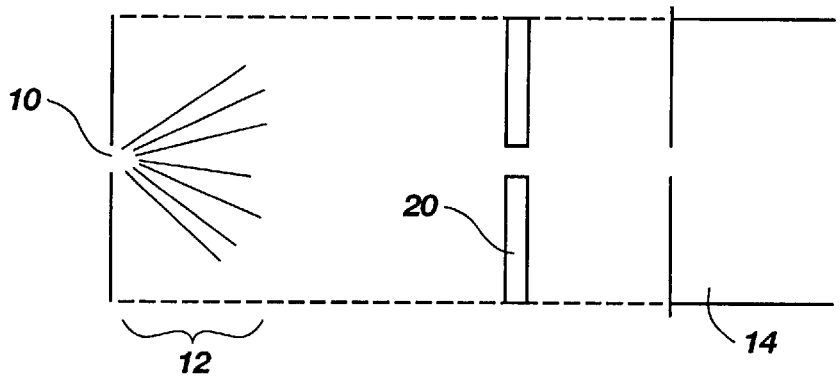
Fig. 3 (PRIOR ART)
FIG. 3 is a profile cross-sectional view of the prior art where a supersonic expansion is being used as in FIG. 1, but with the addition of an electrostatic (or magnetic) lens for focusing ions.

Likewise, in another alternative embodiment, ion lenses like the one shown in FIG. 3 could be placed in the system in addition to collisional focusing without departing from the spirit of the invention. Because the molecular motion of the background gas is highly organized, the random thermal motion that would be induced in the ions cooled in a bulk gas at ambient temperature is largely avoided. A well collimated beam is produced regardless of ion mass, and the velocity distribution of the ion beam would be very narrow compared to conventional systems.

A somewhat related approach has been used for injection of ions into a quadrupole mass spectrometer. It differs from the present invention in several respects. First, it is not used in conjunction with a time of flight mass spectrometer. Second, the presence of supersonic expansion is an incidental feature of the approach and is not used to impart any particular benefit. This is because the functioning of a quadruple mass spectrometer is not particularly sensitive to the properties of the ion beam being analyzed. However, in a time of flight mass spectrometer, function is very dependent on the properties of the ion beam being injected into the instrument. Therefore, the presence of a supersonic expansion is a significant factor in the operation of the present invention which utilizes a time of flight mass spectrometer.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A system for injecting a collimated beam of ions into a time of flight mass spectrometer, where the ions are injected from a supersonic expansion into the time of flight mass spectrometer, said system comprising:

an ion entrance in a chamber, to inject the ions into the time of flight mass spectrometer;

a supersonic expansion beam of ions from the ion entrance where the supersonic expansion beam has an identifiable axis which represents ion movement;

a radio frequency (RF) field generated by a plurality of RF electrodes having an axis which is generally coincident with the supersonic expansion beam axis directed towards the entrance of the time of flight mass spectrometer wherein the supersonic beam passes through and terminates beyond the RF electrodes; and a free jet expansion gas which is a component of the supersonic expansion beam within which ions collide with molecules comprising the free jet expansion gas, such that the ions which reach the entrance of the time of flight mass spectrometer are cooled and collimated through interaction with the RF field and the free jet expansion gas, and have a relatively high intensity because of collisions within the free jet expansion gas which substantially avoid collisions with stagnant background gas.

2. A system as defined in claim 1 wherein an accelerated gas is made a part of the supersonic expansion by introduction of the accelerated gas into a supersonic expansion nozzle with the ions, such that the accelerated gas and the ions are emitted from the supersonic expansion nozzle and towards the RF field.

3. A method for injecting a collimated beam of ions into a time of flight mass spectrometer, where the ions are injected from a supersonic expansion into the time of flight mass spectrometer, said method comprising the steps of:

(1) providing an entrance for ions being injected into the time of flight mass spectrometer;

(2) generating a supersonic expansion beam of ions where the supersonic expansion beam has an identifiable axis which represents ion movement;

(3) generating a radio frequency (RF) field having an axis which is generally coincident with the supersonic expansion beam axis, and which is directed towards the entrance of the time of flight mass spectrometer; and (4) inserting into the supersonic expansion beam an accelerated free jet expansion gas, wherein the supersonic expansion beam and the free jet expansion gas pass through the radio frequency RF field which functions as an energy dissipation mechanism such that the ions which reach the entrance of the time of flight mass spectrometer are generally cooled and collimated through interaction with the RF field and the free jet expansion gas and have a relatively high intensity due to the accelerated free jet expansion gas.

4. A system for injecting a collimated beam of ions into a time of flight mass spectrometer, where the ions are injected from a supersonic expansion into the time of flight mass spectrometer, said system comprising:

an ion entrance to inject the ions into the time of flight mass spectrometer;

a supersonic expansion beam of ions where the supersonic expansion beam has an identifiable axis which represents ion movement;

a radio frequency (RF) field generated by a plurality of RF electrodes having an axis which is generally coincident with the supersonic expansion axis of the ions and is directed towards the entrance of the time of flight mass spectrometer, wherein the supersonic expansion beam passes through the RF electrodes; and a free jet expansion gas which is a component of the supersonic expansion beam and passes through the RF field and RF electrodes to collide with the ions, such that the ions which reach the entrance of the time of flight mass spectrometer are cooled and collimated through interaction with the RF fields and the free jet expansion gas, and have a relatively high intensity because of collisions with the free jet expansion gas to thereby substantially avoid collisions with stagnant background gas.

5. The system of claim 4 wherein the ion entrance, the supersonic expansion beam from the ion entrance and the RF electrodes are in one same chamber.

* * * * *